United States Patent [19]

Ferguson

[11] 4,391,076

[45] * Jul. 5, 1983

[54] ROOF OR SIDEWALL CONSTRUCTION

[76] Inventor: Stewart Ferguson, P.O. Box 12, Aloha, Wash. 98525

[ * ] Notice: The portion of the term of this patent subsequent to Oct. 20, 1998, has been disclaimed.

[21] Appl. No.: 253,495

[22] Filed: Apr. 13, 1981

Related U.S. Application Data

[63] Continuation-in-part of Ser. No. 59,998, Jul. 23, 1979.

[51] Int. Cl.[3] ..... E04D 1/00

[52] U.S. Cl. ..... 52/553; 52/560

[58] Field of Search ..... 52/518, 519, 527, 529, 52/531, 533, 535, 540, 541, 543, 547, 549, 551, 553, 560

[56] References Cited

U.S. PATENT DOCUMENTS

| | | | |
|---|---|---|---|
| Re. 27,574 | 2/1973 | Kough et al. | 52/541 |
| 1,887 | 10/1840 | Docker | 52/543 |
| 1,690,396 | 11/1928 | Block | 52/529 |
| 1,860,181 | 5/1932 | Horne | 52/529 |
| 1,885,346 | 11/1932 | Marshberger | 52/527 |
| 1,924,650 | 8/1933 | Payne | 52/560 |
| 2,103,076 | 12/1937 | Marshberger et al. | 52/518 |
| 2,138,663 | 11/1938 | Miles | 52/518 |
| 3,068,920 | 12/1962 | Chandler et al. | 144/281 |
| 3,440,777 | 4/1969 | Martin | 52/94 |
| 3,664,081 | 5/1972 | Martin et al. | 52/540 |
| 3,720,031 | 3/1973 | Wilson et al. | 52/560 |
| 4,262,466 | 4/1981 | Roe | 52/533 |
| 4,295,314 | 10/1981 | Ferguson | 52/553 |

*Primary Examiner*—Peter M. Caun

*Attorney, Agent, or Firm*—Ward Brown; Douglas E. Winters; Robert W. Beach

[57] ABSTRACT

Generally rectangular wood shake covering elements laid up in overlapping courses are spaced apart transversely of their lengths by sawn wood shingle filler elements. Preferably the major portion of the overlapped portion of each course is formed by the tips of the sawn shingle filler elements, whereas the major portion of the exposed portion of each course is formed by the wood shake covering elements. One of such elements can be notched providing a transversely extending shoulder dividing such element into tip and butt portions of unequal width. In application, the shoulder tightly abuts the adjacent element. The covering and filler elements can be used to construct a roofing panel which includes a sawn shingle underlayer beneath each course and waterproof paper which underlies at least the major portion of the shingle underlayer but which is secured to the roofing panel by having one end portion interposed between the underlayer and the covering or filler element at one end of the panel. The covering elements can have registered kerf lines to align the successive courses of panels.

24 Claims, 24 Drawing Figures

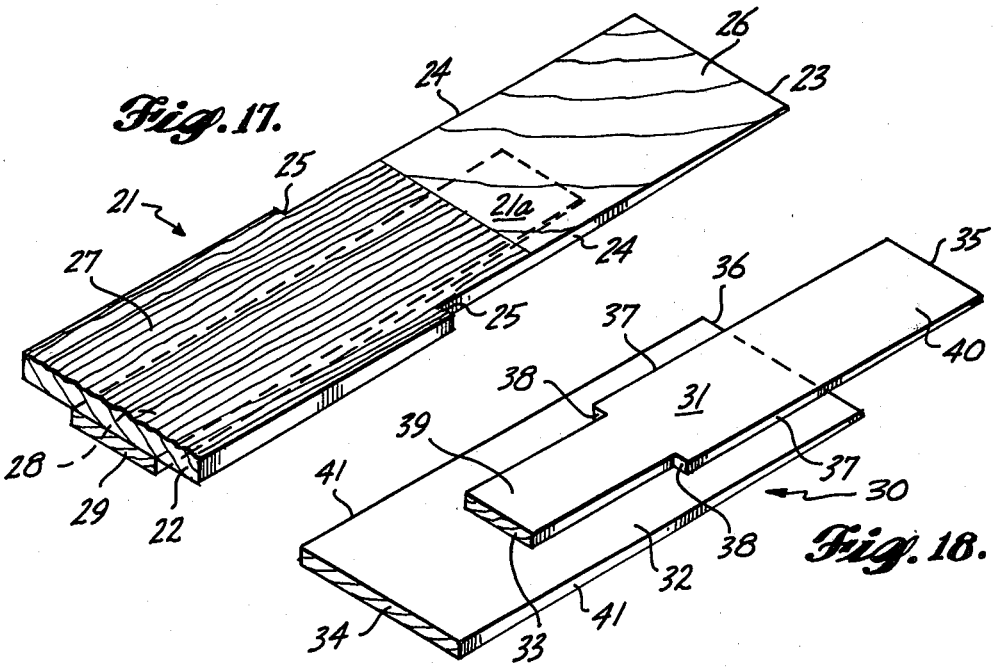
Fig. 17.
Fig. 18.
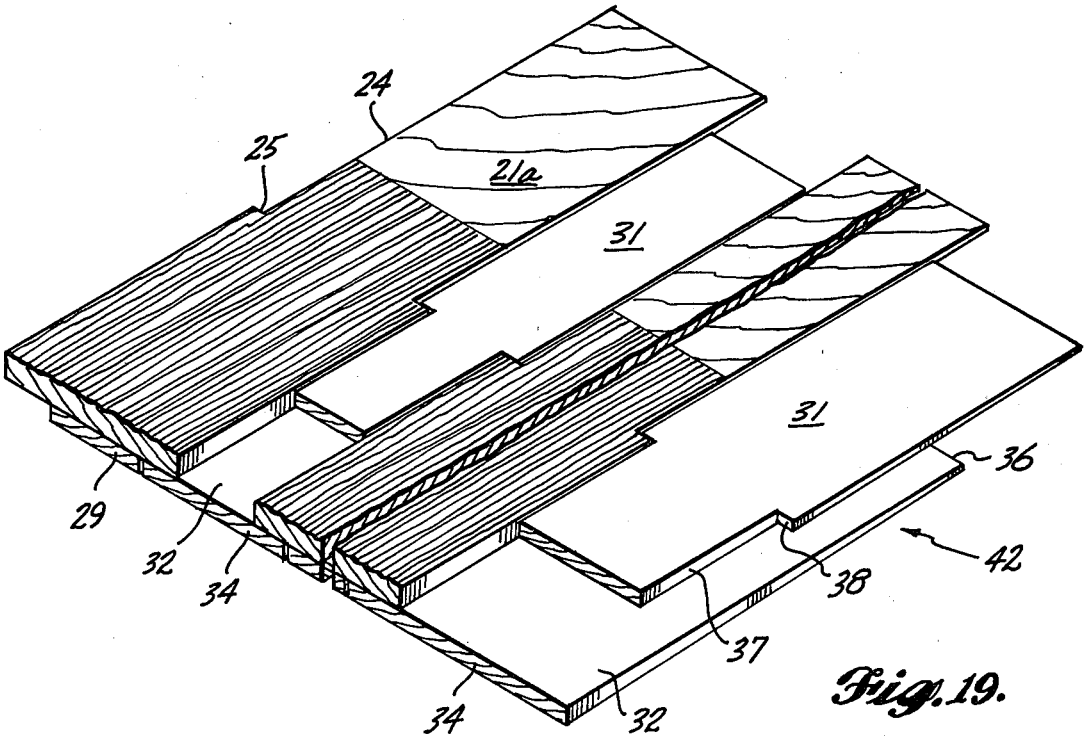
Fig. 19.

ROOF OR SIDEWALL CONSTRUCTION

CROSS-REFERENCE

This application is a continuation-in-part of my copending application Ser. No. 059,998, filed July 23, 1979, for Shouldered Shake and Filler Roof Structure, which is expressly incorporated by reference herein.

BACKGROUND OF THE INVENTION

1. Field of the Invention

The present invention relates to sloping roofs and upright sidewalls of the type having horizontal rows of wooden covering elements applied in overlapping courses.

2. Prior Art

It is known to apply generally rectangular wood shakes in overlapping courses to form the roof of a building structure. The adjacent sides of adjacent shakes in a course are always spaced apart slightly to enable expansion of the shakes transversely of the grain resulting from changes in moisture content and/or temperature without buckling.

Strips of building felt under the shakes of one course may cover the tip portions of the shakes of the next lower course. Nevertheless, rain or snow may be blown upward through the spaces between adjacent shakes and beneath the felt strips, which results in leaks. In addition, in case of a roof fire, air circulates readily between the shakes increasing the rate at which the fire spreads. As evidenced by U.S. Pat. Nos. 3,664,081 and Re 27,574, the problem of blowback of rain and snow previously has been recognized, and it has been proposed to apply a furring strip adjacent to the upper edge of each course of shakes.

Multipiece shingle panels are known utilizing an elongated backing board to which a course of shingles is applied. In the panel disclosed in U.S. Pat. No. 3,440,777 a sheet of waterproof material, an underlayer course of shingles and a face course of shakes are secured to an elongated "base strip" which can be plywood. In the panel disclosed in U.S. Pat. No. 3,068,920, shakes are laid over a veneer strip which, in turn is laid over a course of shingles.

SUMMARY OF THE INVENTION

It is an object of the present invention to provide a roof or sidewall structure of the type including wood shakes applied in overlapping courses, in which the adjacent sides of the exposed portions of adjacent shakes may be spaced apart without increasing the tendency of the roof or sidewall structure to leak due to blowback and without increasing the rate at which fire would spread should a fire occur.

It also is an object to provide such a structure which retains the durability and appearance of shakes while reducing the amount of shake material required.

Another object is to provide panels from which such a structure can be constructed, thereby reducing installation time and effort.

A further object is to provide such a roof or sidewall structure using component parts that are easy to manufacture, formed from readily available building elements and easy to apply.

Some of the foregoing objects can be accomplished by providing a roof structure including wood shakes and sawn shingle plugs or fillers having portions fitted between adjacent shakes. Either the shakes or fillers can have stepped sides forming transversely extending shoulders dividing the shakes or fillers into tip and butt portions of unequal width. The shoulders can abut corresponding ends of adjacent fillers or shakes in a course.

In a preferred embodiment of the invention, a filler cut from a sawn shingle is fitted between adjacent shakes such that the adjacent sides of the adjacent shakes are spaced apart a substantial distance to reduce the amount of shake material required. The tips of the shakes and fillers of each course are overlapped by the butt portions of the shakes in the next higher or successive course so that only the butt portions of the shakes and the fillers are exposed to the weather. Optionally, the fillers can be entirely overlapped by the butt portions of the shakes in the successive course so that only the spaced shake butt portions are exposed.

In another preferred embodiment of the invention, a roofing panel unit is formed having an underlayer of side-by-side rectangular sawn shingles. The top or face layer of the panel has alternating shakes and sawn shingles. Preferably, the shakes are spaced apart substantial distances and cover only the lower portion of the sawn shingle underlayer; and, preferably, the remainder of the roofing panel face layer is assembled from low-grade or cull sawn shingle elements including notched fillers having narrow butt portions fitted between adjacent shakes and wide tip portions covering the upper portion of the sawn shingle underlayer.

BRIEF DESCRIPTION OF THE DRAWINGS

FIGS. 17 and 18 are top perspectives of component parts of another roof structure in accordance with the present invention, FIG. 17 showing a wide individual generally rectangular covering element, such as a shake, having a narrower backing layer, and FIG. 18 showing a narrow plug or filler, such as a sawn shingle, having a wider backing layer.

FIG. 19 is a top perspective of a roof or sidewall panel using the components illustrated in FIGS. 17 and 18, parts being broken away.

EXPLANATION OF TERMINOLOGY

Figure 1:
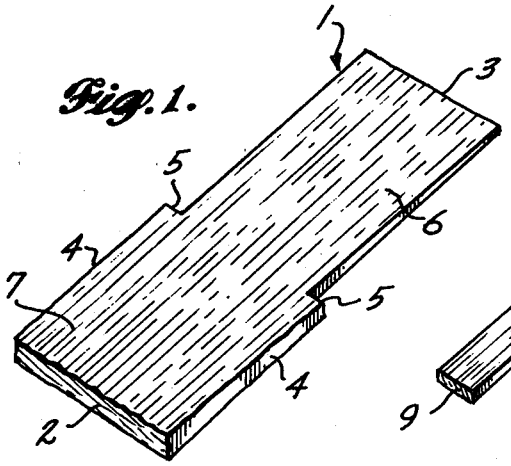
FIG. 1 and FIG. 2 are top perspectives of component parts of a roof structure in accordance with the present invention, FIG. 1 showing an individual generally rectangular covering element, such as a shake, constructed in accordance with the invention, and FIG. 2 showing a plug or filler, such as a sawn shingle, constructed in accordance with the invention.

For purposes of this application "wood shingles" defines generally rectangular wooden covering elements usually applied in side-by-side relationship in each of several overlapping courses to cover a sloping roof or an upright sidewall supporting structure. The term is generic to "sawn shingles" and "shakes".

"Sawn shingles" have smooth sawn upper and lower surfaces, almost always are tapered in thickness lengthwise of the grain and usually are 16 inches (40.5 cm) to 18 inches (45.7 cm) in length and may be of uniform or random width.

"Shakes" have at least their upper surfaces formed by splitting, or at least upper surfaces that have been grooved to resemble a split surface such as by rotating steel brushes or by being milled. Shakes sometimes are tapered lengthwise of the grain and typically are 24 inches (61 cm) in length and of random width.

The butts of tapered shakes generally are thicker than the butts of tapered sawn shingles. The more time-consuming manufacturing operation and the requirement of using higher grade material, and more of it, make shakes substantially more expensive than sawn shingles.

DETAILED DESCRIPTION

As shown in FIG. 1, one component part of a roof or sidewall structure in accordance with the present invention is a generally rectangular individual covering element, such as a wood shake 1, which has a rough upper surface and preferably is tapered in thickness. Such a shake includes a thicker butt end 2, a thinner tip end 3 and longitudinal sides 4 connecting the shake butt and tip ends. The sides 4 of the shake are stepped, providing transverse shoulders 5 facing the tip end of the shake and dividing the shake into a narrower tip portion 6 and a wider butt portion 7. The opposite sides of the shake tip and butt portions are generally parallel and each shoulder 5 extends substantially perpendicular to such sides, such that the side of each butt portion is offset from the corresponding side of the tip portion a distance equal to the depth of a shoulder. Preferably the two shoulders are of the same depth, which should be within the range of $\frac{1}{4}$ inch (0.64 cm) and $1\frac{1}{2}$ inches (3.8 cm), preferably being about $\frac{3}{4}$ inch (1.9 cm).

Figure 2:
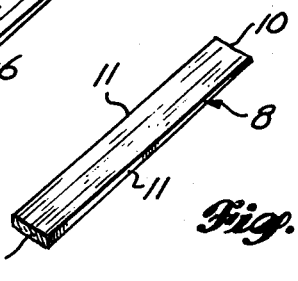

As shown in FIG. 2, the second component of a roof or sidewall structure in accordance with the present invention is a generally rectangular plug or filler 8 which conveniently may be cut from a sawn wood shingle. Such a filler has a thicker butt end 9, a thinner tip end 10 and parallel sides 11 connecting the butt and tip ends. The length of the filler is approximately the same as the length of the shake tip portion 6. The width of the filler is substantially greater, preferably about $\frac{1}{4}$ inch (0.64 cm) to $1\frac{1}{2}$ inches (3.8 cm) greater, than the combined depths of two shoulders 5. If the shoulders are $\frac{3}{4}$ inch (1.9 cm) deep, the filler should be about $1\frac{3}{4}$ inches (4.4 cm) to 3 inches (7.6 cm) wide, preferably about $2\frac{1}{4}$ inches (5.7 cm) wide. The thickness or height of the filler butt should be approximately the same as the thickness of a shake at its shoulders.

Figure 3:
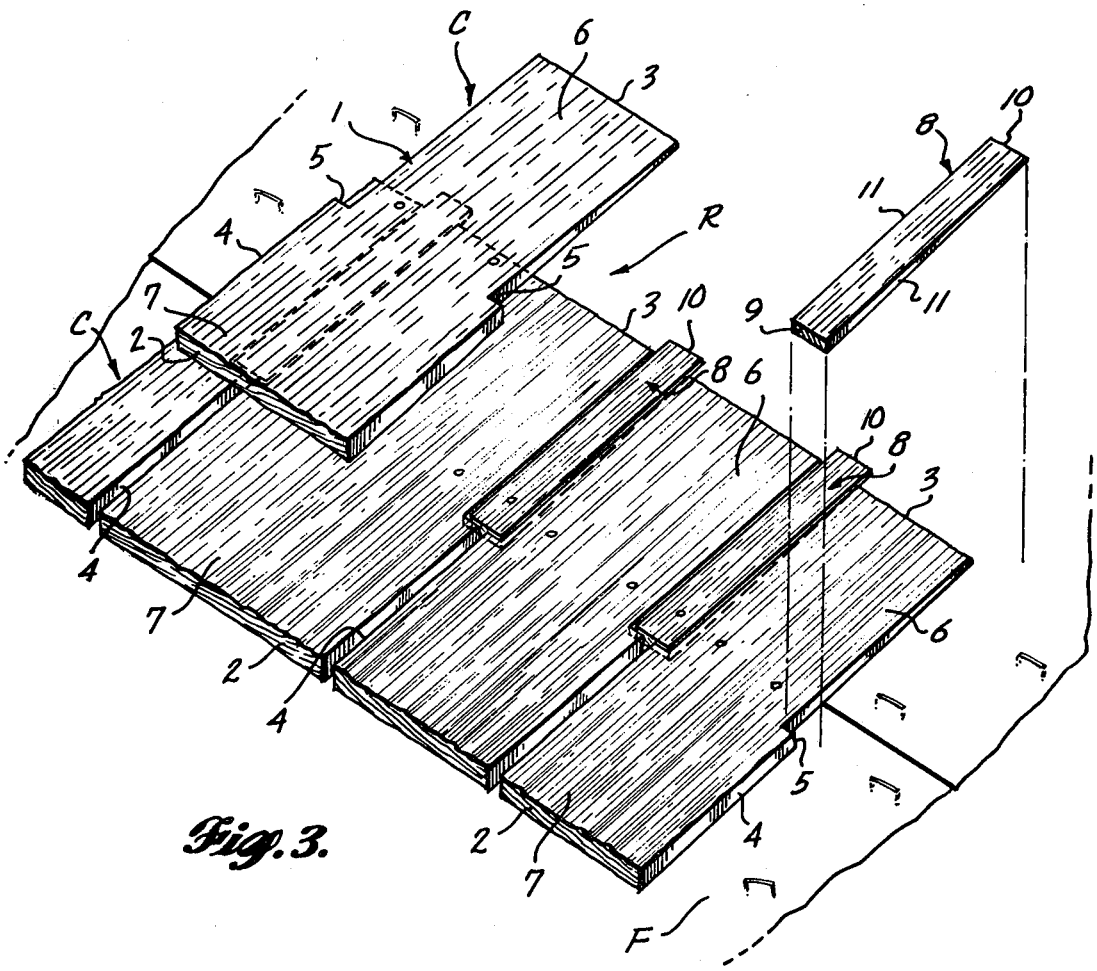
FIG. 3 is a somewhat diagrammatic top perspective of a portion of a roof structure in accordance with the present invention using the components of FIGS. 1 and 2, parts being shown in exploded relationship.
Figure 4:
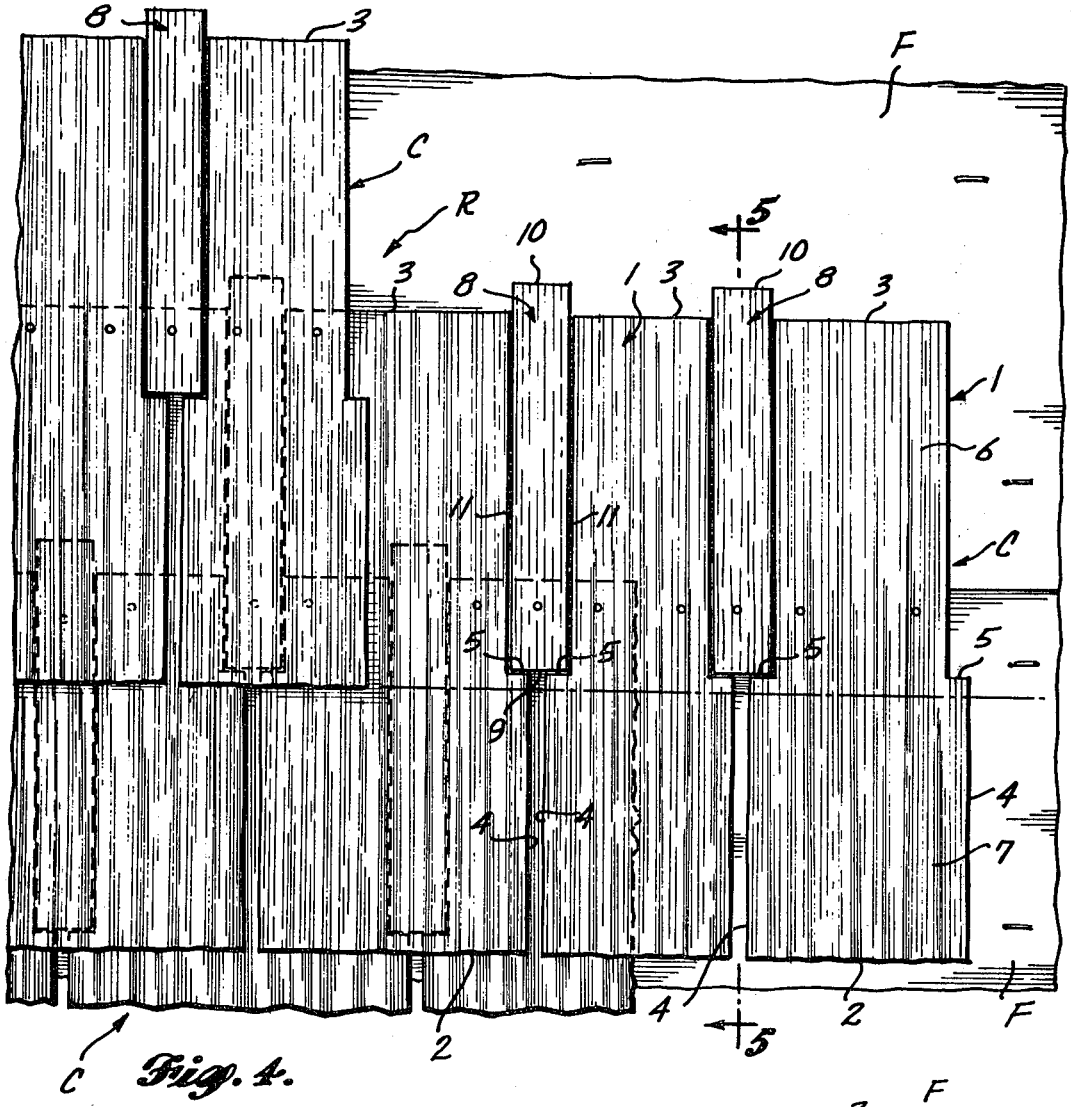
FIG. 4 is a top plan of a portion of a roof structure in accordance with the present invention using the components of FIGS. 1 and 2.
Figure 5:
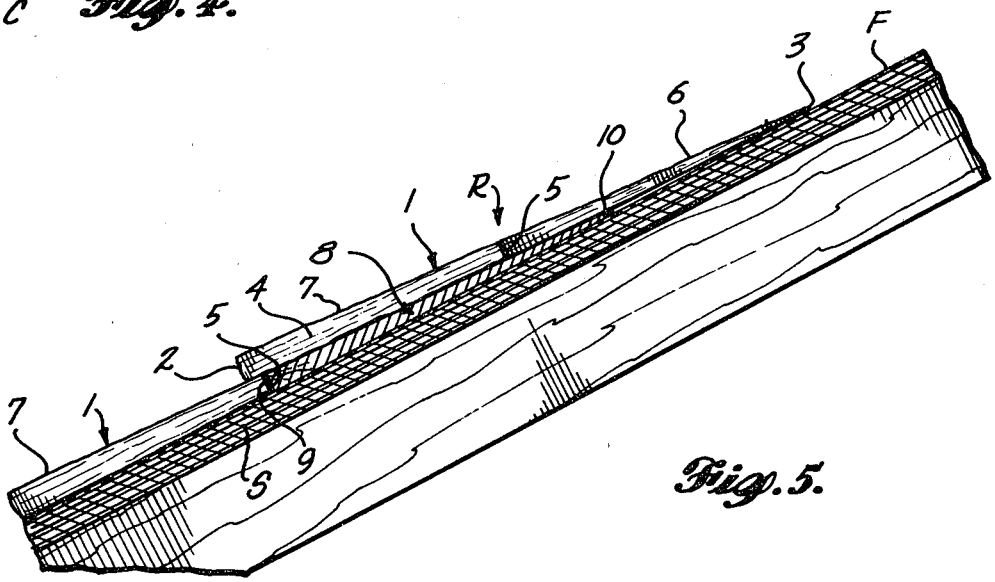
FIG. 5 is a section taken along line 5—5 of FIG. 4.

The components shown in FIGS. 1 and 2 are utilized in a roof structure R in the manner shown in FIGS. 3, 4 and 5. Such roof structure includes roof boards or sheathing S on which a layer of roofing felt F or other waterproof material is laid. Except in the starter course, a shake 1 is applied over the tip portions of shakes in the next lower course. The tip portion of such shake partially overlies the boards or sheathing S. Next a filler 8 is applied with one of its sides 11 substantially in engagement with a side of the tip portion 6 of the shake just applied and the butt 9 of the filler abutting a shake shoulder 5. Next, another shake is applied with a side of its tip portion substantially in engagement with the side 11 of the filler opposite the filler side adjacent to the first shake and a shoulder 5 of the second shake abutting the butt 9 of the filler.

Since the width of the filler is substantially greater than the combined depths of the shoulders it engages, the adjacent sides of the butt portions 7 of adjacent shakes are spaced apart at least to the extent that the width of the filler exceeds the combined depths of the shake shoulders. The shake butt portions should be spaced apart at least $\frac{1}{4}$ inch (0.64 cm). A pleasing rustic appearance, and a substantial saving of the more expensive shake material, can be achieved with substantially greater spacing of the shake butt portions. In one embodiment of the invention, the width of a filler exceeds the combined depths of two shoulders by about $\frac{3}{4}$ inch (1.9 cm) so that the shake butt portions are spaced apart about $\frac{3}{4}$ inch (1.9 cm).

The application method is continued to form a course C of alternating shakes and fillers with the butt ends 2 of the shakes substantially coplanar. Successive overlapping courses C then are applied with the spaces between shakes of each succeeding course out of registration with the spaces between the shakes of the preceding course.

The spacing of the shake shoulders from the shake butt end 2 is determined by the length of the shake butt portion it is desired to expose to the weather. Such shoulders should be overlapped approximately $\frac{1}{2}$ inch (1.3 cm) by the shakes of the next succeeding course. In a representative installation, the shakes are 24 inches (61 cm) long with about 10 inches (25.4 cm) of the butt portion of each shake exposed to the weather. In such a representative installation, each shake shoulder is spaced about $10\frac{1}{2}$ inches (26.7 cm) from the butt end of the shake.

The thickness or height of the butt ends 9 of the fillers 8 are substantially equal to the thickness of the shakes 1 at the shoulders 5 and the filler butts abut the shake shoulders tightly, so that such fillers form plugs between adjacent shakes at their shoulders. Also, the thickness of a filler throughout its length should be approximately equal to the corresponding thickness of the adjacent shake tip portions so that the bottom surfaces of the shakes of each course closely overlie the upper surfaces of the shakes and fillers of the next lower course.

The fillers prevent rain or snow from being blown up between the sides of shakes in the same course and between the upper surfaces of shakes in a lower course and the bottom surfaces of shakes in the next higher course, assuring that the completed roof structure is weathertight. In addition, in case of fire, the fillers or plugs act as fire stops deterring the passage of air between adjacent shakes so that the fire will spread less quickly than without such fillers or plugs. Further, as discussed above, the use of wide fillers spacing apart the adjacent edges of the butt portions of adjacent shakes provides a substantial saving in expensive shake material and gives a pleasing rustic appearance to the completed roof structure without reducing its weather-tight character.

Figure 7:
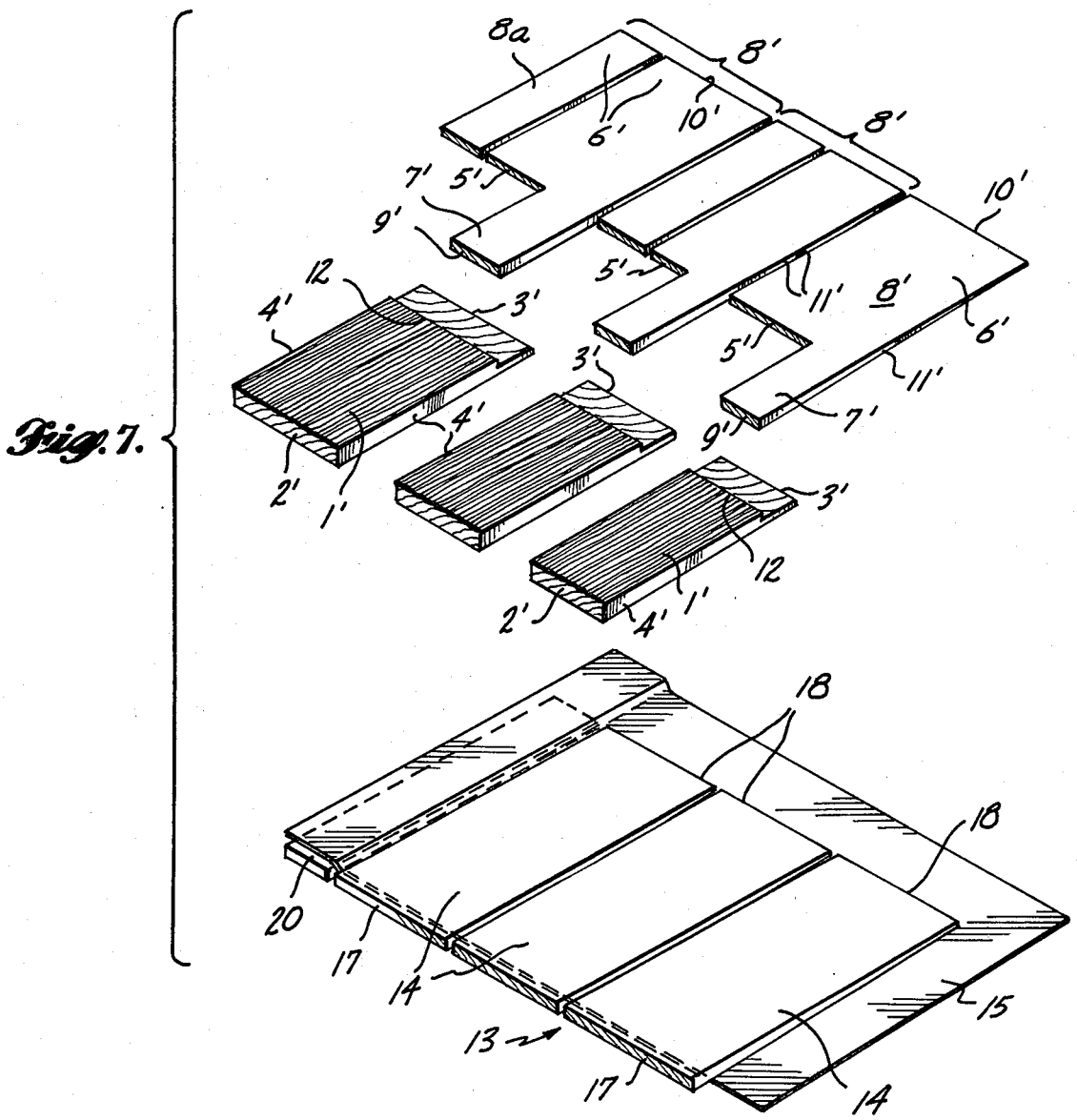
FIG. 7 is a top perspective of the panel of FIG. 6 with parts being shown in exploded relationship.
Figure 6:
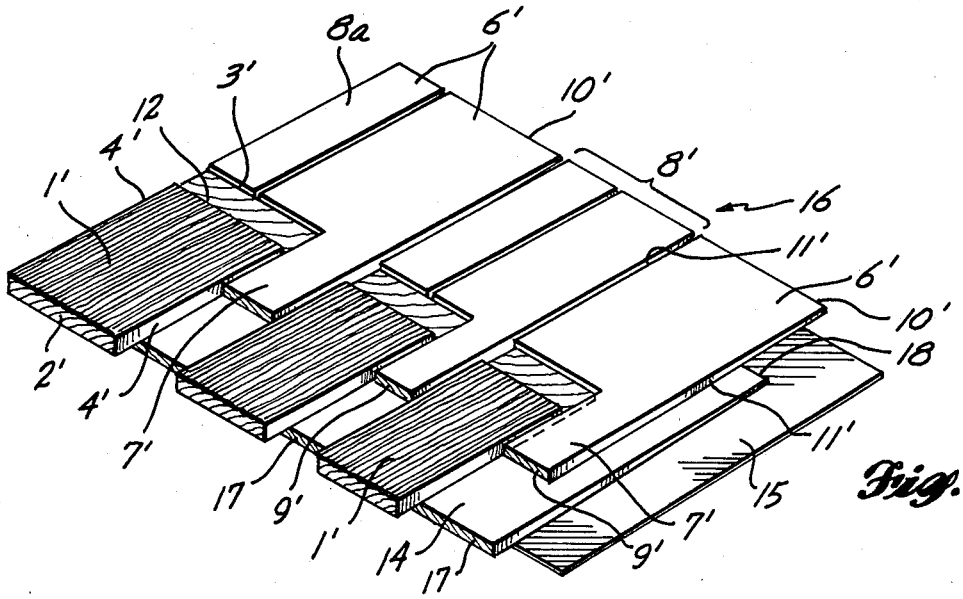
FIG. 6 is a top perspective of a roof or sidewall panel in accordance with the present invention.

The embodiment of the present invention shown in FIGS. 6 through 13 uses covering element and plug or filler components to form a roofing panel. As shown in FIGS. 6 and 7, the covering element is a generally rectangular shake 1' which has a butt end 2', a tip end 3' and generally parallel longitudinal sides 4' connecting the shake butt and tip ends. The opposite sides of the shake are generally parallel and, preferably, the shake is tapered in thickness from the butt end 2' to the tip end 3'. Although the shake is approximately 12 inches (30.5 cm) in length, its thickness and taper are the same as the butt portion of a standard 24 inch (61 cm) shake. Approximately a 2 inch (5 cm) wide portion of the rough upper surface of each shake is removed adjacent to the tip end 3', such as by routing, leaving a kerf line 12 parallel to the butt end 2' and tip and 3'.

The plug or filler component 8' of the roofing panel may be cut from a sawn wood shingle. Such filler includes a butt end 9', a tip end 10' and longitudinal sides 11' connecting the filler butt and tip ends. One of the sides 11' of the filler is stepped, providing a transverse shoulder 5' facing the butt end of the filler and dividing the filler into a wider tip portion 6' and a narrower butt portion 7'. The opposite sides of the filler tip and butt portions are generally parallel and the shoulder extends substantially perpendicular to such sides.

The width of the filler tip portion 6' should equal the combined widths of the filler butt portion 7' and the shake 1' which will abut the filler shoulder 5' when the roofing panel is assembled with the butt portion 7' of the filler fitted between adjacent shakes; that is, the lateral extent or depth of the filler shoulder 5' is approximately equal to the width of the shake. Therefore, the upper portion of the stepped side of the filler will be in registration with a side of the shake. If a single sawn shingle filler piece is narrower than the preferred width, a filler extender **8*a* may be used to form the composite filler as shown toward the left of FIG. 6**.

Figure 10:
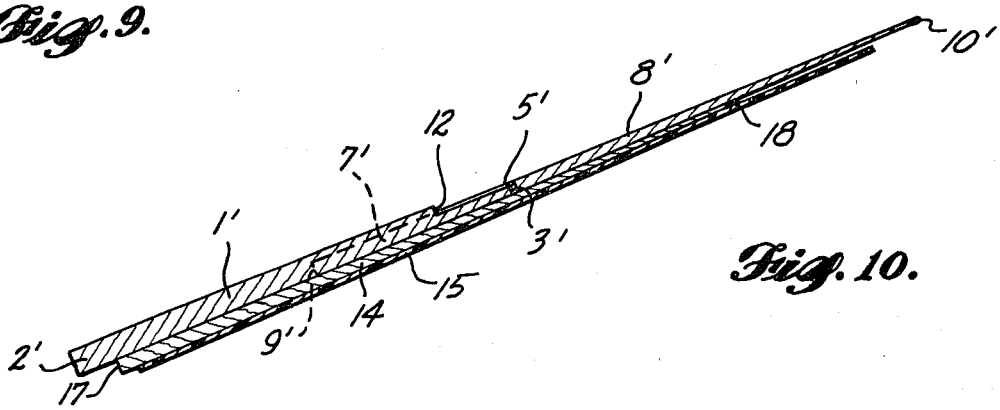
FIG. 10 is a section taken along line 10—10 of FIG. 8.

Preferably the length of the filler tip portion 6', i.e. the distance from the tip end 10' to the shoulder 5', is approximately the same as the length of the shake 1'. The thickness or height of the filler butt portion 7' should be approximately the same as the thickness of the portion of an adjacent shake with which it is generally aligned when the roofing panel is assembled, as best seen in FIG. 10.

The covering element and filler components can be assembled with an underlayer 13 of sawn shingles 14 and suitable waterproof sheet material 15 to form the roofing or sidewall panel 16 shown in FIGS. 6 and 7. The sawn shingles 14 of the underlayer 13 are low-grade sawn shingles which may include knots, for example. Preferably, the underlayer shingles 14 are tapered from their butt ends 17 to their tip ends 18.

Figure 9:
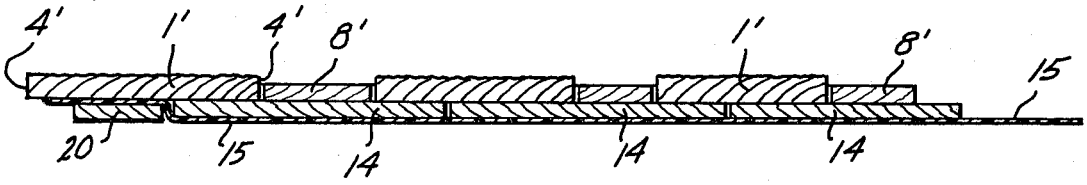
FIG. 9 is a section taken along line 9—9 of FIG. 8.

As shown in FIGS. 7 and 9, the waterproof sheet material 15, which can be standard roofing felt, underlies the major portion of the underlayer 13 of sawn shingles 14 and is secured to the panel at one end by being interposed between a narrow underlayer sawn shingle 20 and the adjacent covering element and filler components. This method of securing the waterproof paper into the roofing panel enables simple construction of the roofing panel and avoids tacking the sheet at both ends of the roofing panel which, as a result of poor workmanship, could result in wrinkles and in the eventual loss of watertight integrity.

To assemble the roofing panel 16, the underlayer sawn shingles 14 are arranged over the waterproof sheet material 15, with the exception of the end sawn shingle 20 which is overlapped by the sheet. Such underlayer shingles are assembled in side adjacent relationship with the adjacent sides of adjacent shingles spaced apart slightly and the butt ends of such shingles substantially coplanar. The shakes 1' and fillers 8' are applied alternately over the underlayer. The shakes cover the major portion of the lower half of the underlayer sawn shingle course and the shake butt ends 2' overhang the butt ends 17 of the underlayer sawn shingles. Adjacent shakes are spaced apart by the butt portion 7' of a filler 8', and the opposite sides of such filler butt portion preferably are in substantially contiguous engagement with the sides of the adjacent shakes. Similarly, preferably the filler shoulder 5' is substantially contiguously abutted by the shake tip end 3'. Filler extenders **8*a*' are applied as required to assure that the upper portion of the course of underlayer sawn shingles is covered by the tip portions 6' of the fillers which include the extenders 8*a***. Such filler tip portions overhang the tips of the underlayer sawn shingles. Care is taken to ensure that none of the spaces between adjacent shakes exposes a joint between adjacent underlayer shingles.

Figure 8:
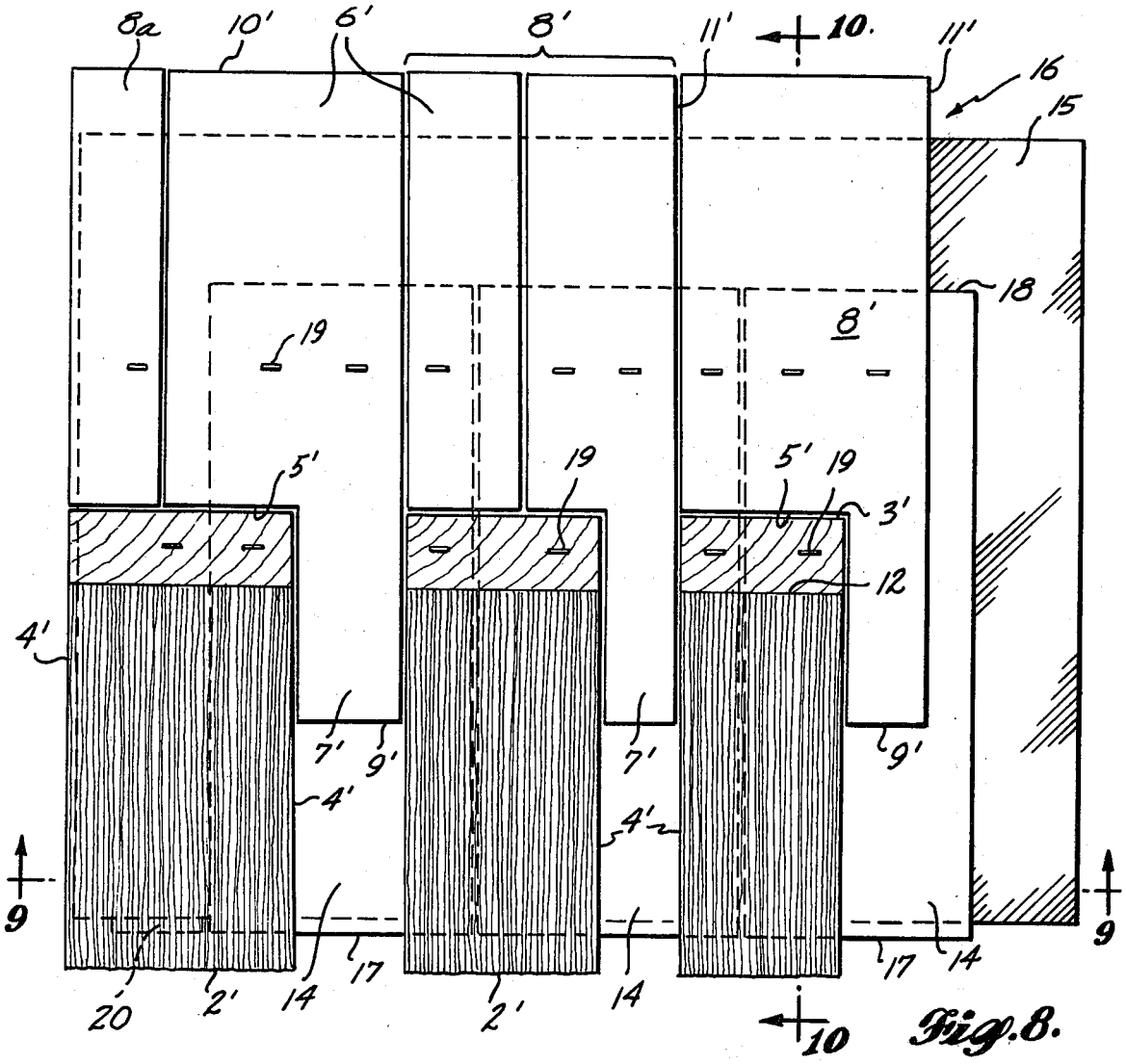
FIG. 8 is a top plan of the panel of FIG. 6.

The roofing or sidewall panel components are secured in conventional manner such as with staples 19 as indicated, for example, in FIG. 8. The staples can be applied through the shakes 1' in the area between the tip end 3' and the kerf line 12, and through the fillers 8' in the filler tip portions 6' so that the staples will be hidden by the successive course of roofing panels. The kerf line 12 serves as a guide to align the successive courses of assembled panels as seen, for example, in FIGS. 11 and 12. By securing the successive courses of panels to the roof or sidewall with the lower ends of the underlayer sawn shingles of the successive panel aligned with the kerf line 12 of the shakes of the next lower panel, the successive courses are maintained parallel and a uniform exposure is assured.

The end portion of the waterproof sheet 15 opposite the end secured over the end underlayer shingle 20 extends beyond the sawn shingle underlayer, and the secured end portion of the sheet, as best seen in FIG. 9, extends beyond the exposed side of the sawn shingle 20 up to the exposed side of the covering element and filler which are secured over the sawn shingle 20. Therefore, as a course of roof panels is laid up on a building structure, the covering element and filler secured over the sawn shingle 20 overlap the exposed end portion of the sawn shingle underlayer of the preceding roof panel. In addition, and waterproof sheet 15 of the preceding panel underlies a portion of the sawn shingle underlayer of the succeeding panel.

Figure 12:
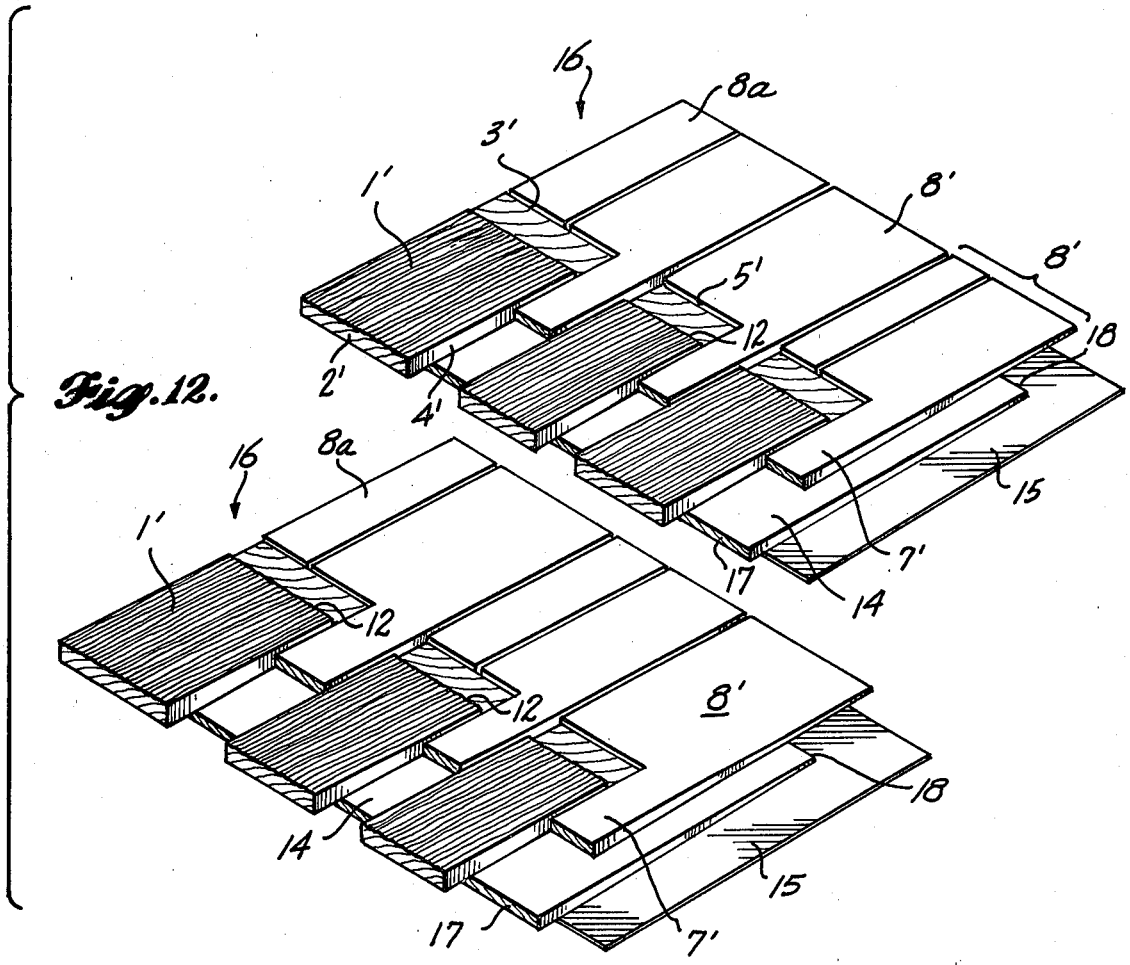
FIG. 12 is a corresponding top perspective showing two of such panels in exploded relationship.
Figure 11:
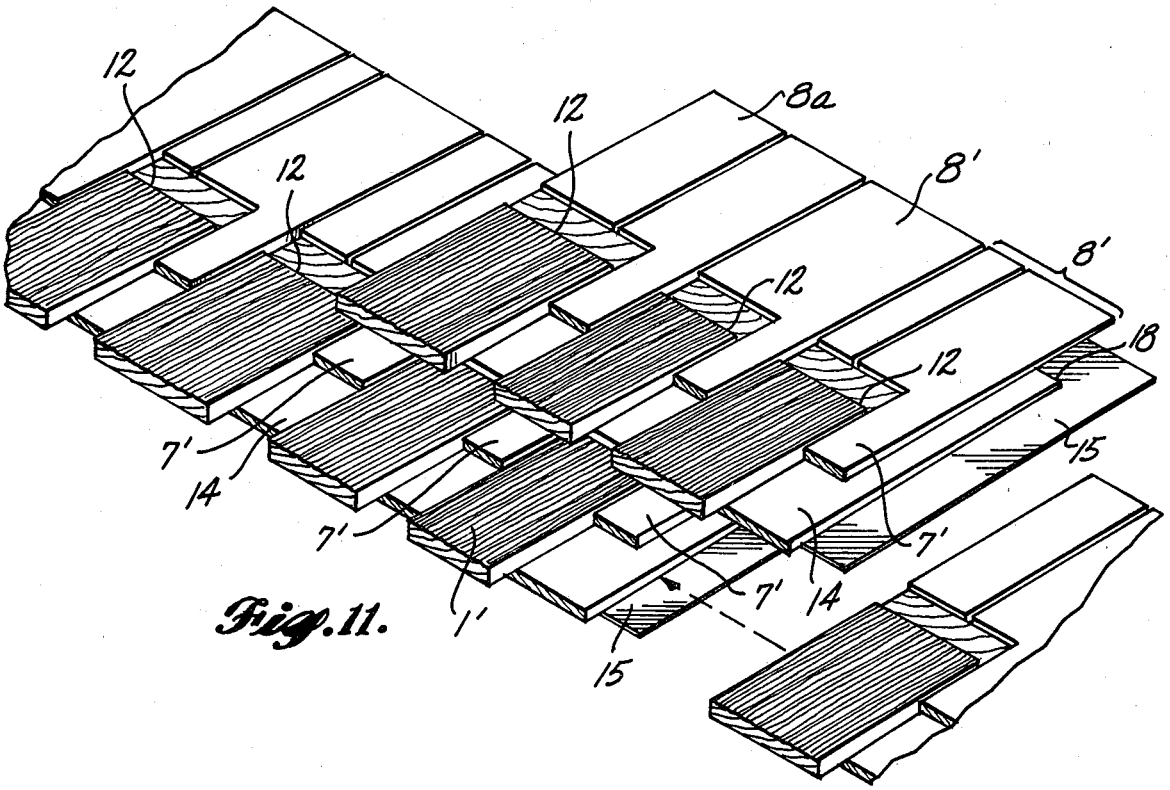
FIG. 11 is a somewhat diagrammatic top perspective of a plurality of panels of the type shown in FIG. 6, illustrating application of the panels to form a roof covering.
Figure 13:
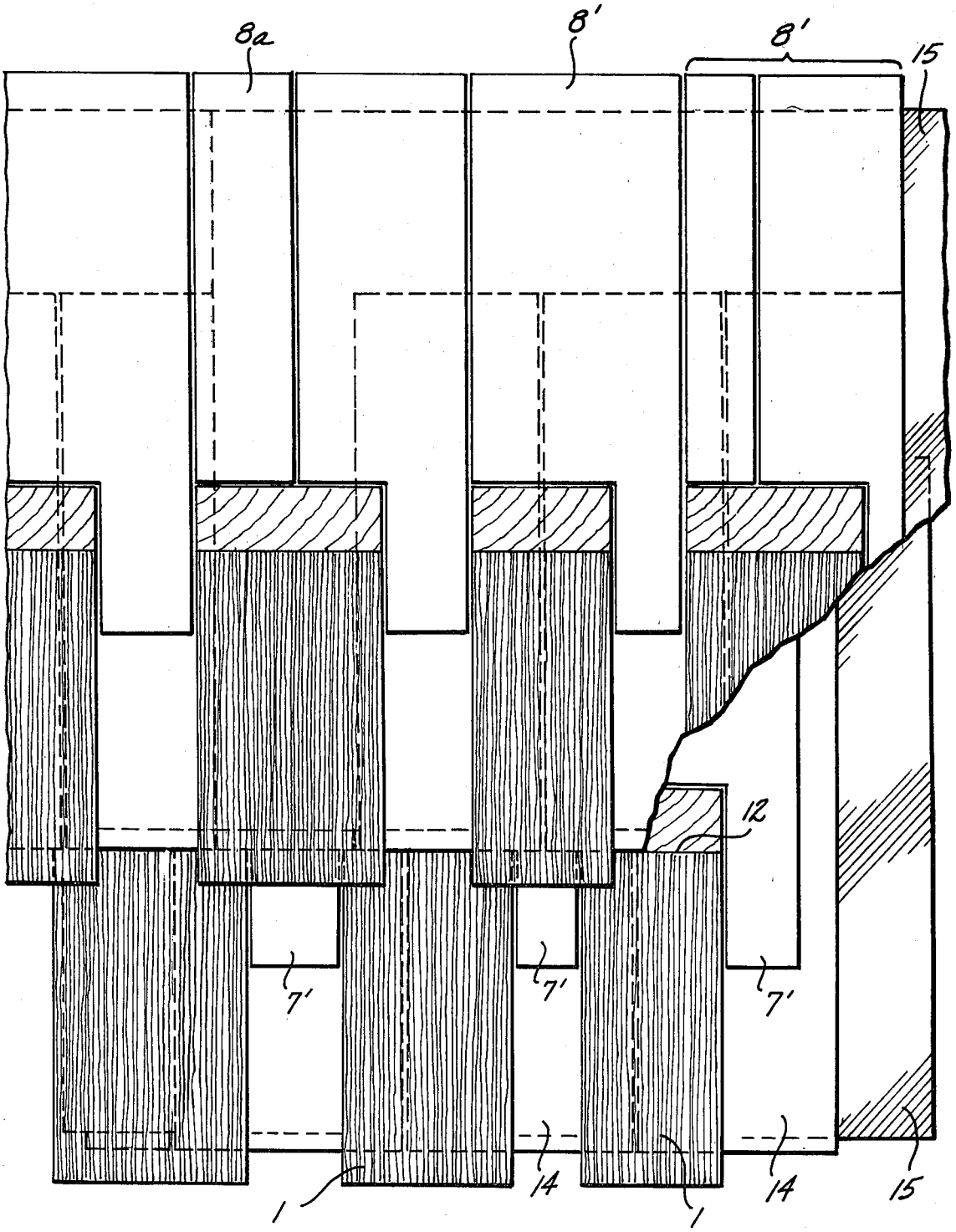
FIG. 13 is a top plan of a portion of a representative roof structure formed by such panels.

The length of the filler butt portion 7' depends on whether the lower tip of the butt portion is to be exposed, as indicated in FIGS. 11, 12 and 13, or is to be completely overlapped by a panel of the next higher course. The exposed butt portion embodiment of FIG. 12 is preferred, since the exposed butt portion 7' would cover knots and other defects in the sawn shingles 14 of the roof panel underlayer 13. This allows use of a lower grade underlayer sawn shingle, without reducing the attractiveness of the finished roof or sidewall.

Figure 14:
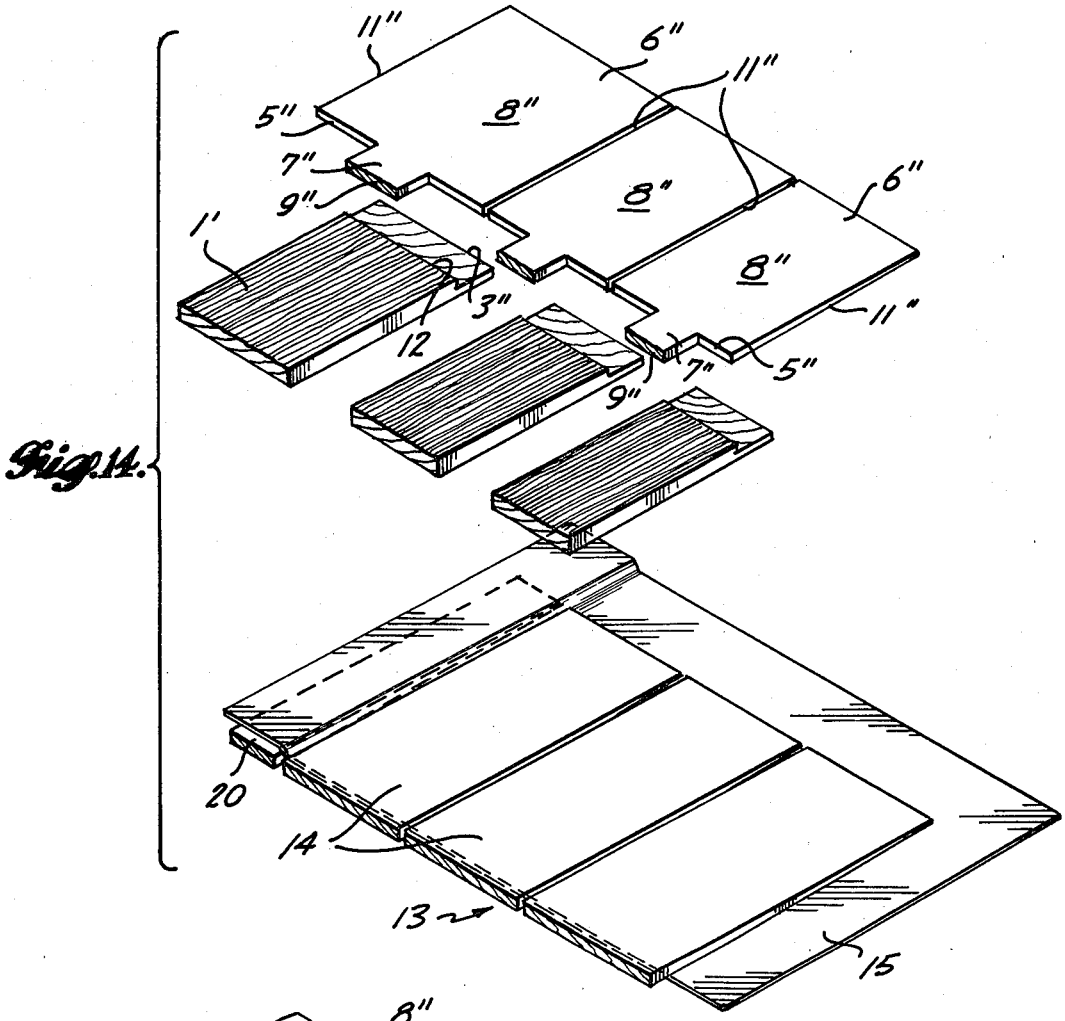
FIG. 14 is a top perspective of a second roof or sidewall panel in accordance with the present invention, parts being shown in exploded relationship.
Figure 15:
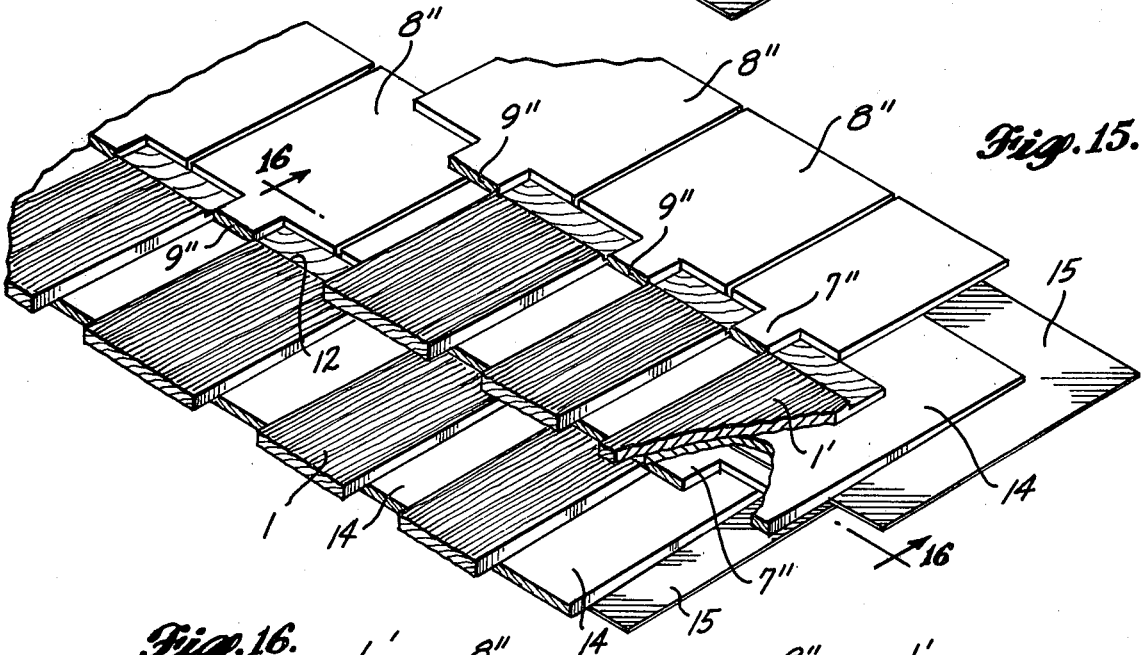
FIG. 15 is a top perspective of a portion of a roof structure in accordance with the present invention using panels of the type shown in FIG. 14, parts being broken away.
Figure 16:
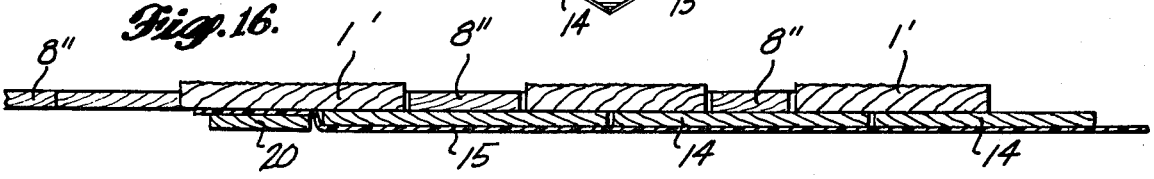
FIG. 16 is a section taken along line 16—16 of FIG. 15.

The embodiment shown in FIGS. 14 to 16 is identical to the embodiment shown in FIGS. 6 through 13 with the exceptions that; both sides 11'' of each of the fillers 8'' is stepped, forming two shoulders 5'' each of which extends substantially perpendicular to the filler sides, dividing the filler into a butt portion 7'' and a tip portion 6'' of unequal width; and the butt portion 7'' of the filler is shorter. Although slightly more expensive to construct, this embodiment improves the weathertightness of the resulting roofing panel because the tip end 3' of both adjacent covering elements 1' abut a shoulder 5'' of the filler. The shorter filler butt portions extend downward between adjacent shakes only to the kerf line 12. Therefore, as shown in FIG. 15, the butt end 9'' of the filler 8'' is not exposed in the completed roof structure, resulting in a somewhat different appearance than the embodiment of FIGS. 6 through 13.

The embodiment of the present invention shown in FIGS. 17 to 20 utilizes a composite shake covering element 21 and a composite sawn shingle filler element 30. The shake covering element 21, shown in FIG. 17, includes a 24 inch (61 cm) shake **21*a* which is approximately $\frac{5}{8}$ inch (1.6 cm) in thickness at its butt end 22 and 1/16 inch (0.16 cm) in thickness at its tip end 23. The sides 24 of the shake are stepped, providing transverse shoulders 25 facing the tip portion 26 which is narrower than the butt portion 27. The opposite sides of the shake tip and butt portions are generally parallel, and each shoulder 25** extends substantially perpendicular to such sides. The two shoulders are of the same depth, preferably approximately $\frac{1}{2}$ inch (1.3 cm).

The composite shake covering element 21 includes an 18 inch (45.7 cm) underlayer sawn shingle 28, narrower than the shake **21*a*, laterally centered beneath the shake with the underlayer shingle butt end 29 substantially coplanar with the shake butt end 22. The underlayer shingle butt end thickness is approximately 0.45 inches (1.15 cm). The underlayer shingle 28 can be secured to the shake 21*a* by blind staples, that is, staples of lengths less than the combined thicknesses of the underlayer shingle 28 and shake 21*a***, such staples being applied from the underside of the underlayer shingle.

The composite sawn shingle filler element 30, shown in FIG. 18, includes two 18 inch (45.7 cm) sawn shingles 31, 32 having butt ends 33, 34, respectively, each approximately 0.45 inch (1.15 cm) in thickness. Such shingles are tapered toward their tip ends 35, 36, respectively. The upper or face shingle 31 is generally rectangular and has stepped longitudinal sides 37 providing transverse shoulders 38 facing the butt end 33 of the face shingle 31 and dividing the face shingle into a narrower butt portion 39 and a wider tip portion 40. The opposite sides of the face shingle tip and butt portions are generally parallel and each shoulder 38 extends substantially perpendicular to such sides. The two shoulders are of the same depth, preferably approximately $\frac{1}{2}$ inch (1.3 cm).

A backing or underlayer sawn shingle 32 of the composite filler element 30 is generally rectangular in shape, having parallel sides 41 connecting the butt and tip ends 34 and 36, respectively. The width of the backing shingle 32 is greater than the width of the tip portion 40 of the face shingle 31, such that the backing shingle extends laterally beyond the opposite sides of the butt portion 39 of the face shingle a distance approximately equal to the lateral overlap of the shake **21*a* beyond the sides of the underlayer sawn shingle 28. The length of the butt portion 39 of the face shingle 31 is approximately 5 to $5\frac{1}{2}$ inches (12.7 to 14 cm), and the face shingle 31 is secured to the backing shingle 32 with, for example, blind staples, so that the butt end 33 of the face shingle 31 is offset approximately 5 to $5\frac{1}{2}$ inches (12.7 to 14 cm) from the butt end 34 of the backing shingle 32**.

The composite components 21 and 30 are laid up on a roof or a wall with the sides of the sawn underlayer shingle 28 and backing shingle 32 closely adjacent and a portion of the butt portion 27 of the shake **21*a* overlying a portion of the backing shingle 32. The butt end 34 of the backing shingle 32 is substantially coplanar with the butt end 29 of the underlayer shingle 28, the upper surface of the face shingle 31 is substantially coplanar with the upper surface of the shake 21*a* and the adjacent shoulders 25 and 38 interlock, as shown in FIG. 19**.

The components are applied to a roofing felt-covered roof or sidewall with nails similar to the components of FIGS. 1 and 2 except that a composite shake covering element 21 and a composite sawn shingle filler element 30 are applied at the same time so that a portion of the shake **21*a* will overlie a portion of both adjacent backing shingles 32 and the longitudinal sides 24 of the shake 21*a* will substantially abut the adjacent sides 37 of both adjacent face shingles 31. With the components so positioned, the shoulders 25 of the shake 21*a* and adjacent shoulders 38 of the adjacent face shingles 31** are abutted tightly. A succeeding course is applied with the butt portions of the components overlying the tip portions of the components of the previous course, covering the shoulders and nails of the previous course. Since both faces of each course are substantially coplanar, the butt portion of the succeeding course closely overlies the previous course, deterring blowback of rain and reducing the rate at which fire would spread should a fire occur.

Since only 5 to $5\frac{1}{2}$ inches (12.7 to 14 cm) of the face shingle 31 and backing shingle 32 are exposed, only 5 to $5\frac{1}{2}$ inches (12.7 to 14 cm) of each of the shingles must be clear, that is, free of defects. Therefore, a less expensive shingle material may be used without loss of weathertightness.

Figure 20:
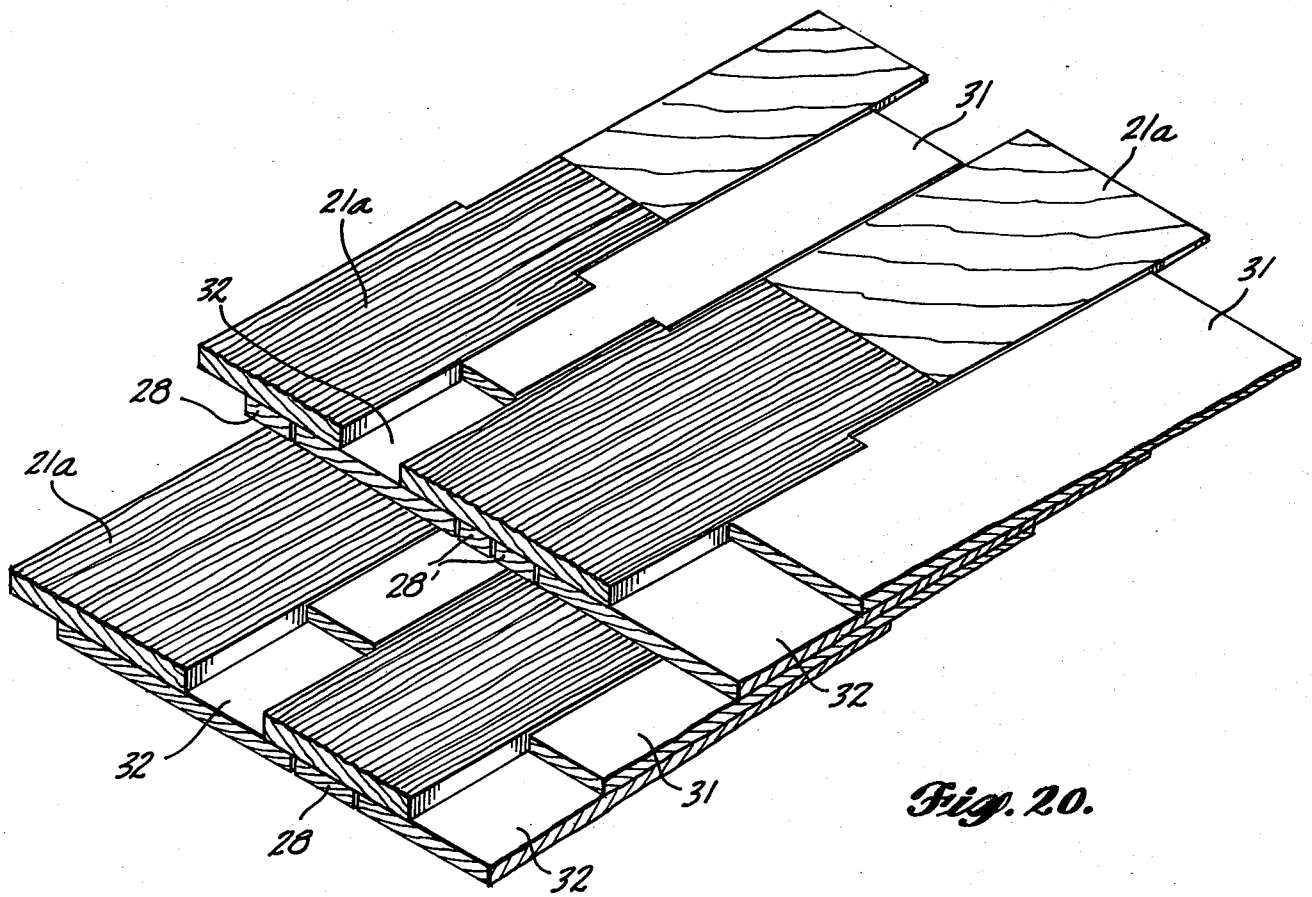
FIG. 20 is a somewhat diagrammatic top perspective of a portion of a roof structure in accordance with the present invention using roofing panels of the type shown in FIG. 19, parts of the panels being broken away.

To increase the ease and speed of application, the composite covering elements 21 and composite filler elements 30 can be assembled into a panel 42, shown in FIG. 19, prior to being secured to the roof or sidewall. The panel components can be secured together by blind staples, for example, with a portion of the shakes **21*a*** overlying portions of the adjacent backing shingles 32, the adjacent sides of the shakes 21*a* and face shingles 31 substantially abutting, and the adjacent shoulders abutting. Application of the panel of a succeeding course over the panel of a preceding course is illustrated in FIG. 20. Preferably the sides of the wood shingles of the succeeding course are not aligned with the sides of the wood shingles of the preceding course.

FIGS. 21 to 24 show a further modification in which the shake 21*a*′ and the face shingle 31′ are generally rectangular and do not include stepped sides forming shoulders. The composite shake covering element 21′ and composite filler element 30′ are applied to a roof or sidewall with the butt end 22′ of the shake 21*a*′ and the butt end 34′ of backing shingle 32′ substantially coplanar, a portion of shake 21*a*′ overlapping a portion of backing shingle 32′, and the adjacent sides 24′ and 37′ substantially abutting. Although less resistant to blowback and spread of fire, the embodiment of FIGS. 21 to 24 requires less material and milling and, therefore, is less expensive to manufacture.

Figure 21:
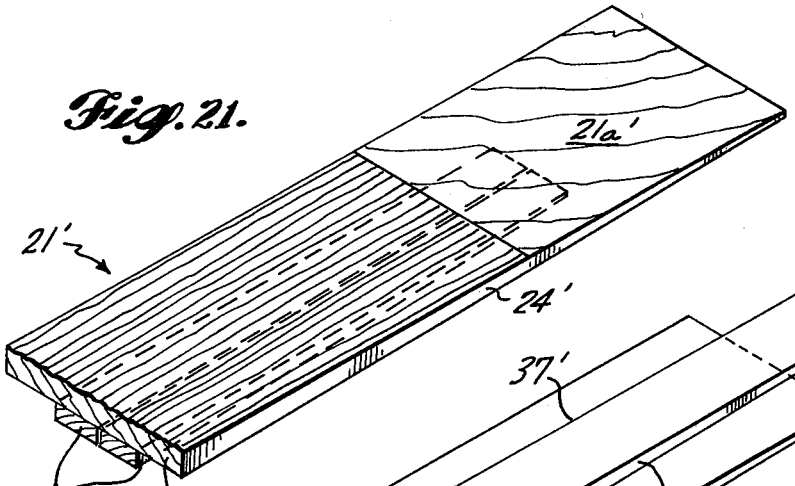
FIGS. 21 and 22 are top perspectives of component parts of still another roof structure in accordance with the present invention, FIG. 21 showing a modified covering element component, and FIG. 22 showing a modified plug or filler component.

Another modification of the embodiment shown in FIG. 21 is the use of two narrow underlayer sawn shingles 28′ in place of one underlayer sawn shingles. This allows the use of otherwise scrap sawn shingles.

Figure 22:
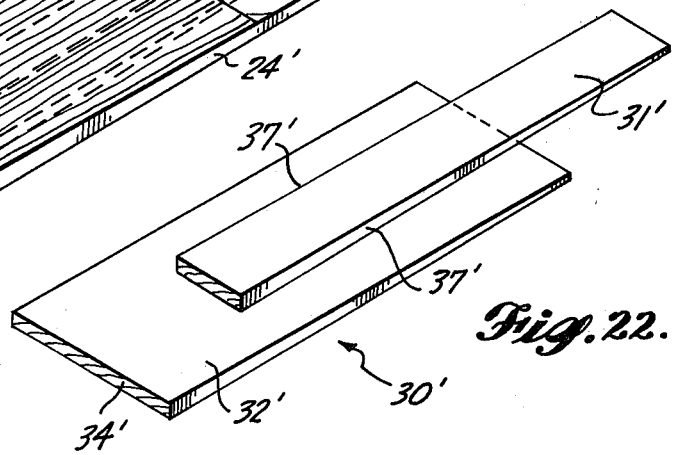
Figure 23:
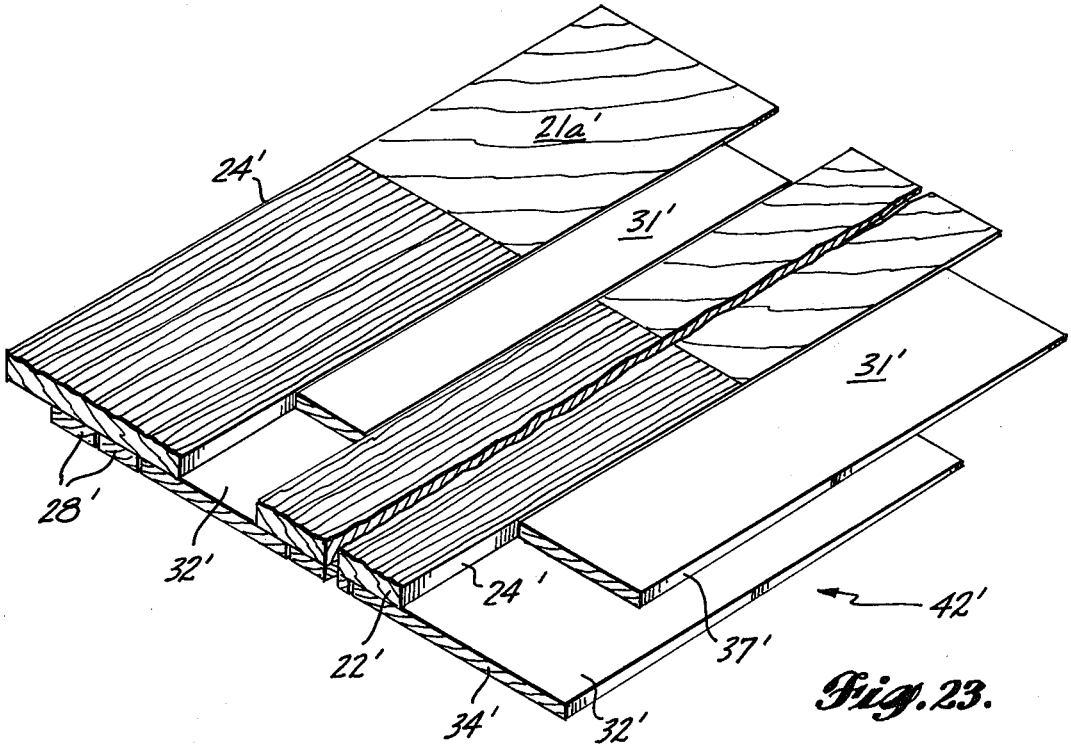
FIG. 23 is a top perspective of a roof or sidewall panel using the components shown in FIGS. 21 and 22, parts being broken away.
Figure 24:
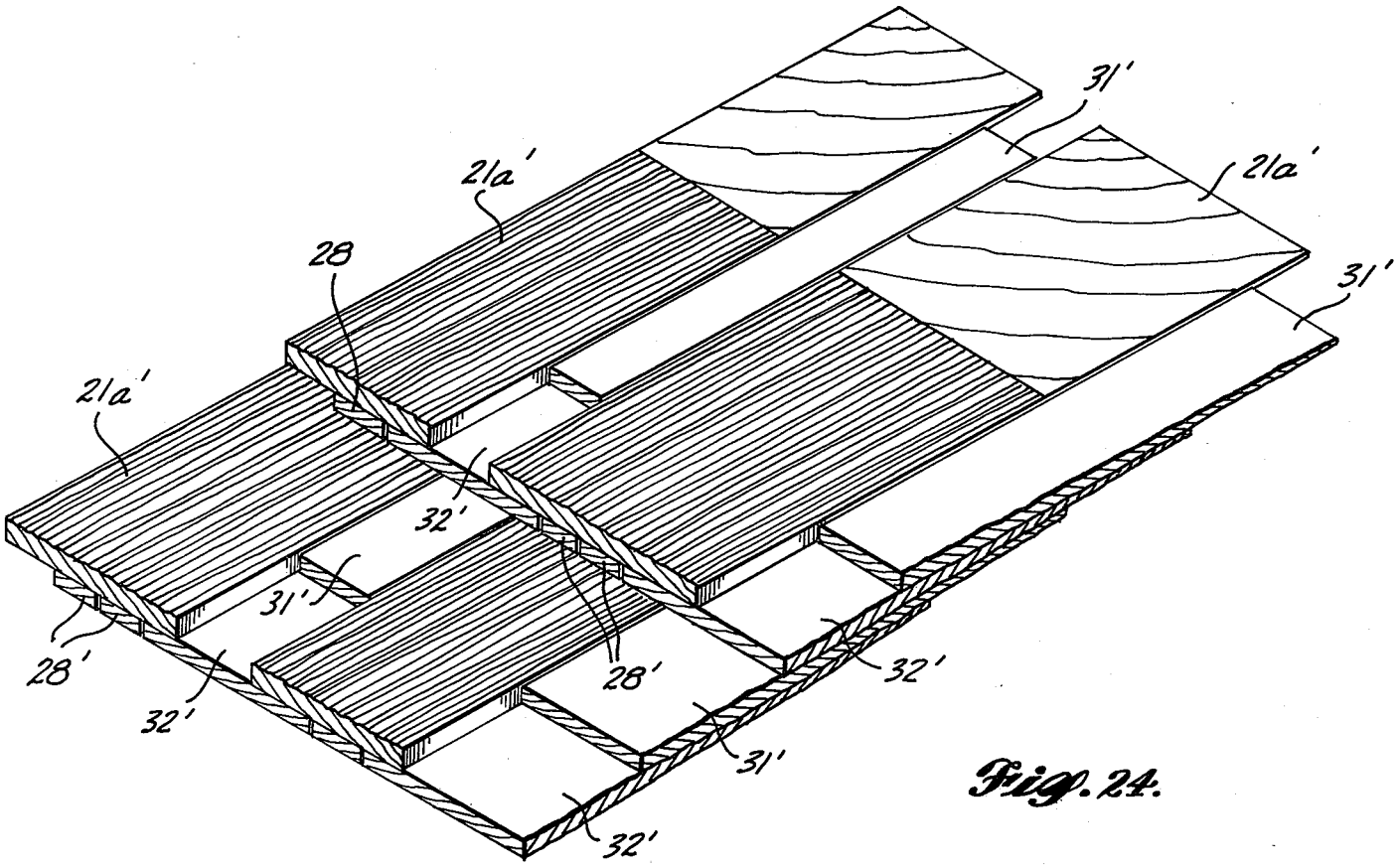
FIG. 24 is a somewhat diagrammatic top perspective of a portion of a roof structure in accordance with the present invention using roofing panels of the type shown in FIG. 23, parts of the panels being broken away.

The FIGS. 21 and 22 elements can be assembled into a panel 42′, shown in FIG. 23, similar to the panel 42 shown in FIG. 19. As shown in FIG. 24, the roofing panels 42′ can be applied to a roofing felt-covered roof-supporting structure with the shakes 21*a*′ of one course in alignment with the shakes of the preceding course. However, the sides of the wood shingles of the succeeding course preferably are not aligned with the sides of the wood shingles of the preceding course. Optionally, shakes and face shingles of random widths can be used so that some of the grooved shakes of one course will be in registration and some will be out of registration with the shakes of the preceding course.

I claim:

1. In a covering for a surface of a building structure, such covering including separate generally rectangular covering elements having respective butt and tip ends and applied in generally coplanar, side adjacent relationship in each of several courses with the tip portions of the covering elements of one course being overlapped by the butt portions of the covering elements of a higher course, the improvement comprising a filler element having respective butt and tip ends, at least one side of said filler element having a shoulder extending transversely of such side and dividing said filler element into a wide tip portion and a narrower butt portion, said filler butt portion being fitted between the adjacent sides of adjacent covering elements in a course and said shoulder abutting the tip end of one of such adjacent covering elements.

2. In a covering for a surface of a building structure, such covering including separate generally rectangular wood shake covering elements having respective butt and tip ends and applied in generally coplanar, side adjacent relationship in each of several courses with the tip portions of the covering elements of one course being overlapped by the butt portions of the covering elements of a higher course, the improvement comprising a tapered sawn wood shingle filler element having a portion fitted between adjacent sides of adjacent covering elements in a course.

3. In the covering defined in claim 1 or 2, the filler element having a butt end in close proximity to the butt end of a covering element of the next higher course.

4. In the covering defined in claim 2, each of the covering elements including a face shake and a sawn shingle underlayer beneath said face shake, and the filler element including a sawn face shingle and a sawn shingle backing beneath said face shingle.

5. In the covering defined in claim 4, the butt end of the face shingle being positioned between the butt and tip ends of the backing shingle, and a portion of one of the adjacent covering elements overlying a portion of the backing shingle.

6. In the covering defined in claim 2, the filler element having a butt end positioned between the butt and tip ends of each of the adjacent shakes.

7. In the covering defined in claim 6, the thickness of the filler element at its butt end being approximately equal to the thickness of the portion of an adjacent shake generally aligned with the filler element butt end.

8. In the covering defined in claim 1, 2, 6 or 7, the course having the filler element including an underlayer of sawn shingles arranged in side-by-side relationship beneath the adjacent covering elements and the filler element.

9. In the covering defined in claim 1, 2, 6 or 7, portions of the opposite sides of the filler elements being in substantially contiguous engagement, respectively, with the facing sides of the adjacent covering elements.

10. In a covering for a surface of a building structure, such covering including separate covering elements applied in side adjacent relationship in each of several courses having respective butt and tip edges with the tip portion of a preceding course being overlapped by the butt portion of a succeeding course and the butt portion of the preceding course exposed, the improvement comprising each of a plurality of such courses including a row of generally side adjacent sawn wood shingles underlying the butt portion of the succeeding course and a row of generally side adjacent wood shakes overlying the tip portion of the preceding course, said wood shakes constituting at least the major portion of the exposed portion of their course.

11. In the covering defined in claim 10, the row of sawn wood shingles including filler elements having portions fitted between the adjacent sides of adjacent shakes.

12. In the covering defined in claim 10 or 11, the wood shingles of the row of wood shingles constituting at least the major portion of the overlapped portion of their course.

13. In a covering for a surface of a building structure, such covering including separate covering elements applied in side adjacent relationship in each of several courses having respective butt and tip edges with the tip portion of a preceding course being overlapped by the butt portion of a succeeding course and the butt portion of the preceding course exposed, each of a plurality of such courses including an underlayer having respective butt and tip edges and formed of sawn wood shingles arranged in side-by-side relationship and an overlayer of generally side adjacent covering elements laid over the underlayer, the improvement comprising at least the major portion of the overlapped portion of each overlayer being a row of side adjacent sawn wood shingles, and at least the major portion of the exposed portion of each overlayer being a row of generally side adjacent wood shakes.

14. In the covering defined in claim 10 or 13, the adjacent sides of adjacent wood shakes in a row being spaced apart a substantial distance.

15. In the covering defining in claim 13, the overlayer row of sawn wood shingles including filler elements having portions fitted between the adjacent sides of adjacent shakes.

16. In a building covering panel including an overlayer having at least two covering elements with respective butt and tip ends, such covering elements being applied in generally coplanar, side adjacent relationship, and an underlayer of wood shingles arranged in side-by-side relationship beneath the overlayer, the improvement comprising the overlayer including a filler element having respective butt and tip ends and a portion fitted between the adjacent sides of the covering elements, at least one side of one of the elements having a shoulder extending transversely of such side, dividing its element into respective butt and tip portions of unequal width and abutting a portion of another of the elements.

17. In the panel defined in claim 16, the filler element having the shoulder, and the adjacent side of one of the covering elements having a second shoulder extending transversely of such adjacent side, dividing such covering element into respective butt and tip portions of unequal width and abutting the shoulder of the filler element.

18. In the panel defined in claim 16, the covering elements including wood shakes tapered in thickness toward their tips and the filler element including a sawn shingle tapered in thickness toward its tip.

19. In the panel defined in claim 16, 17 or 18, the butt end of one of the elements being spaced above the butt end of another of the elements.

20. In the panel defined in claim 16 or 18, a layer of waterproof sheet material underlying at least the major portion of the shingle underlayer, one edge portion of said layer of waterproof sheet material projecting beyond corresponding lateral edges of the overlayer and the underlayer, and the opposite edge portion of said layer of waterproof sheet material being interposed between the overlayer and the underlayer.

21. In the panel defined in claim 16 or 18, at least one of the elements having a kerf line extending substantially parallel to its butt end.

22. In a building covering panel including an underlayer of wood shingles arranged in side-by-side relationship, an overlayer of side adjacent covering elements laid over the underlayer and a layer of waterproof sheet material extending lengthwise of the panel, the improvement comprising one end portion of the layer of the waterproof sheet material underlying the underlayer and the other end portion of the layer of waterproof sheet material being interposed between the underlayer and the overlayer.

23. In the panel defined in claim 22, the layer of waterproof sheet material underlying at least the major portion of the underlayer.

24. In the panel defined in claim 22 or 23, at least one end portion of the layer of waterproof sheet material extending beyond corresponding ends of the underlayer and the overlayer.

* * * * *